United States Patent [19]

Boender et al.

[11] 4,433,883

[45] Feb. 28, 1984

[54] STORAGE AND DISPLAY SYSTEM FOR ROLLS OF DECORATIVE WALL COVERING

[75] Inventors: Carl H. Boender, Lansing, Ill.; Roger M. Zigterman, Highland, Ind.

[73] Assignee: Wallpapers Galore, Inc., Hammond, Ind.

[21] Appl. No.: 313,650

[22] Filed: Oct. 22, 1981

[51] Int. Cl.[3] ..... A47B 47/00; G09F 3/00

[52] U.S. Cl. ..... 312/234.1; 312/107; 312/119; 312/234.3; 312/259; 211/191; 40/312

[58] Field of Search ..... 312/234.1, 234.2, 234.3, 312/234.4, 234.5, 119, 198, 259; 211/191, 60 R; 206/45.34; 40/312; 217/58

[56] References Cited

U.S. PATENT DOCUMENTS

| | | | |
|---|---|---|---|
| 255,063 | 3/1882 | Wheeler et al. . | |
| 291,450 | 1/1884 | White . | |
| 347,638 | 8/1886 | Pettit . | |
| 348,611 | 9/1886 | Beatty | 40/312 |
| 561,085 | 6/1896 | Bowman . | |
| 747,950 | 12/1903 | Davis . | |
| 1,156,644 | 10/1915 | Vetter . | |
| 1,271,783 | 7/1918 | Sherer | 312/119 |
| 1,299,645 | 4/1919 | Whitmore . | |
| 1,379,867 | 5/1921 | Johnson . | |
| 1,504,273 | 8/1924 | Schnebelin . | |
| 1,547,206 | 7/1925 | Diehl . | |
| 1,868,101 | 7/1932 | Hecht . | |
| 2,582,575 | 1/1952 | Young . | |
| 2,871,080 | 1/1959 | Shelly . | |
| 2,872,265 | 2/1959 | Shelly . | |
| 3,011,852 | 12/1961 | Mahan . | |
| 3,321,259 | 5/1967 | Fiterman et al. | 312/259 |
| 3,529,730 | 9/1970 | Thompson | 312/107 |
| 3,942,852 | 3/1976 | Anthony | 312/234.3 |
| 3,986,756 | 10/1976 | Kranich | 312/234.1 |
| 4,175,807 | 11/1979 | Kranich et al. . | |
| 4,179,033 | 12/1979 | Mitchell . | |
| 4,192,439 | 3/1980 | Segal | 206/45.34 |
| 4,261,470 | 4/1981 | Dolan | 211/191 |
| 4,353,461 | 10/1982 | Liang | 206/45.34 |

FOREIGN PATENT DOCUMENTS

| | | | |
|---|---|---|---|
| 1005574 | 9/1965 | United Kingdom | 40/312 |

*Primary Examiner*—Victor N. Sakran

*Attorney, Agent, or Firm*—Leydig, Voit, Osann, Mayer & Holt, Ltd.

[57] ABSTRACT

A system for the storage of rolls of wallpaper and for the display of samples of the wallpaper stored therein comprising a plurality of corrugated cardboard bins placed in close, side-by-side relationship to each other and vertical members of a support frame. A flap is hingedly attached to each bin so as to cover the opening, thus protecting the contents of the bin from a possibly dirty environment and hiding unsightly roll ends. To the front of each flap is attached a transparent pocket for displaying a sample of the wallpaper contained within the bin.

3 Claims, 4 Drawing Figures

STORAGE AND DISPLAY SYSTEM FOR ROLLS OF DECORATIVE WALL COVERING

BACKGROUND OF THE INVENTION

1. Field of the Invention

This invention relates to systems for the storage of rolls of wallpaper and the like and for the display of samples of the wallpaper stored therein.

2. Description of Prior Art

Typically, when choosing a wallpaper pattern, the consumer has had to page through large and cumbersome wallpaper pattern sample books to select the desired pattern. This type of merchandising requires a salesperson to take the identifying number, and either locate the corresponding roll of wallpaper from inventory or order the pattern from a wholesale distributor or jobber.

Recently, however, the technique for marketing wallpaper has changed to one of mass merchandising, operating on a cash and carry, self service basis at high traffic, high volume outlets. An outlet employing this concept typically needs to stock at least six hundred different patterns, and some stock as many as a thousand to fifteen hundred different patterns. The consumer browses through the store, selects a pattern, and picks the roll or rolls of wall covering directly from storage bins.

Several techniques for displaying and storing wallpaper samples for high volume outlets are disclosed in U.S. Pat. Nos. 3,986,756, 4,175,807 and 4,179,033. In each, the storage bin is uncovered, exposing unsightly roll ends to a possibly dirty and dusty environment, and encouraging customer handling or pilfering of the individual rolls. Additionally, each requires either the costly use of skilled labor to custom-construct each unit or the special manufacture of prefabricated components which are assembled into a display and storage unit.

SUMMARY OF THE INVENTION

In light of the foregoing, it is an object of the present invention to provide a combined storage and display system for rolls of wallpaper and the like wherein the roll ends are protected from the environment and hidden from sight.

It is a further object of the present invention to provide a combined storage and display system which uses less floor space than systems of the prior art. A cooperating object is to provide a storage and display system which facilitates simultaneous viewing and comparison of samples of each roll of wallpaper stored within an array of bins.

Finally, it is desired to accomplish these objects while providing a storage and display system which is inexpensive and requires no custom construction or special manufacture of prefabricated components.

According to one aspect of the present invention, a combined storage and display system is provided in which rolls of decorative wall coverings are maintained in stacked, shelved, bins, each bin being covered with a flap containing a protected sample of the wall covering. The combined storage and display has a support frame with vertical supports and a series of horizontal shelves. A number of horizontally elongated parallelepiped bins with substantially rectangular cross-sections are sized to snugly fit in side by side relationship between adjacent bins and the vertical supports. This snug fit allows the support system and bins to interact in supporting the rolls of wallpaper stored within each bin without the deformation of the vertical walls of each bin. Because of this interaction, the bins may be made of inexpensive materials such as corrugated cardboard.

Each bin has a substantially rectangular opening on its front; and on the front of each bin a flap, sized to cover the opening of the bin, is hingedly attached to the top of the bin. This flap prevents the entrance of dirt and dust into the bin, and also provides a surface on which to display a sample of the wallpaper contained within the bin.

These and other features and advantages of the present invention will become apparent in light of the following description and accompanying drawings.

DESCRIPTION OF THE PREFERRED EMBODIMENTS

Figure 1:
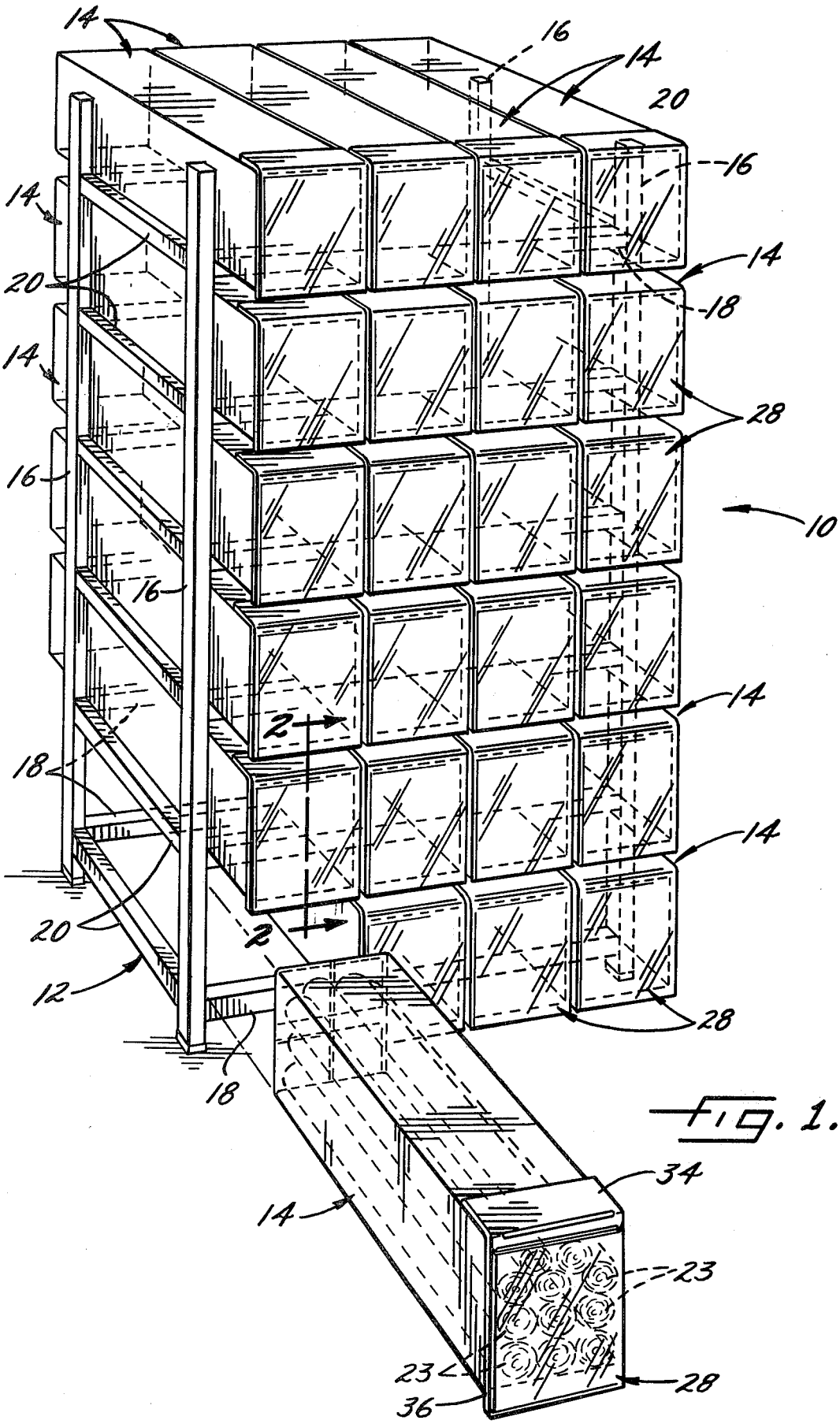
FIG. 1 is an overall perspective view of a display and storage rack embodying the present invention.

As best seen in FIG. 1, a combined storage and display system 10 is formed of a support frame 12 and a plurality of stacked and shelved bins 14.

The support frame 12 is assembled from rectangular metal tube, but any strong wood or metal material would serve equally as well. The support frame has four vertical members or uprights 16, which are bolted to front and rear horizontal members 18 and side horizontal members 20. Each level of horizontal members 18 forms a shelf, and is separated from the next level of horizontal members by a distance which corresponds to the vertical height of the bins. Additionally, the length of the front and rear horizontal members 18 is such that when the bins 14 are placed on the shelves, the vertical walls of adjacent bins 14 are touching, and the bins 14 on either end of the shelves are touching the uprights 16. Thus the bins 14 are securely wedged between either adjacent bins or between an adjacent bin 14 and a pair of uprights 16. The significance of this will become apparent later. Although FIG. 1 shows an array with six shelves having four bins on each shelf, the number of shelves and the number of bins 14 on each shelf is variable and is decided by the needs of each retailer.

Figures 2, 3, 4:
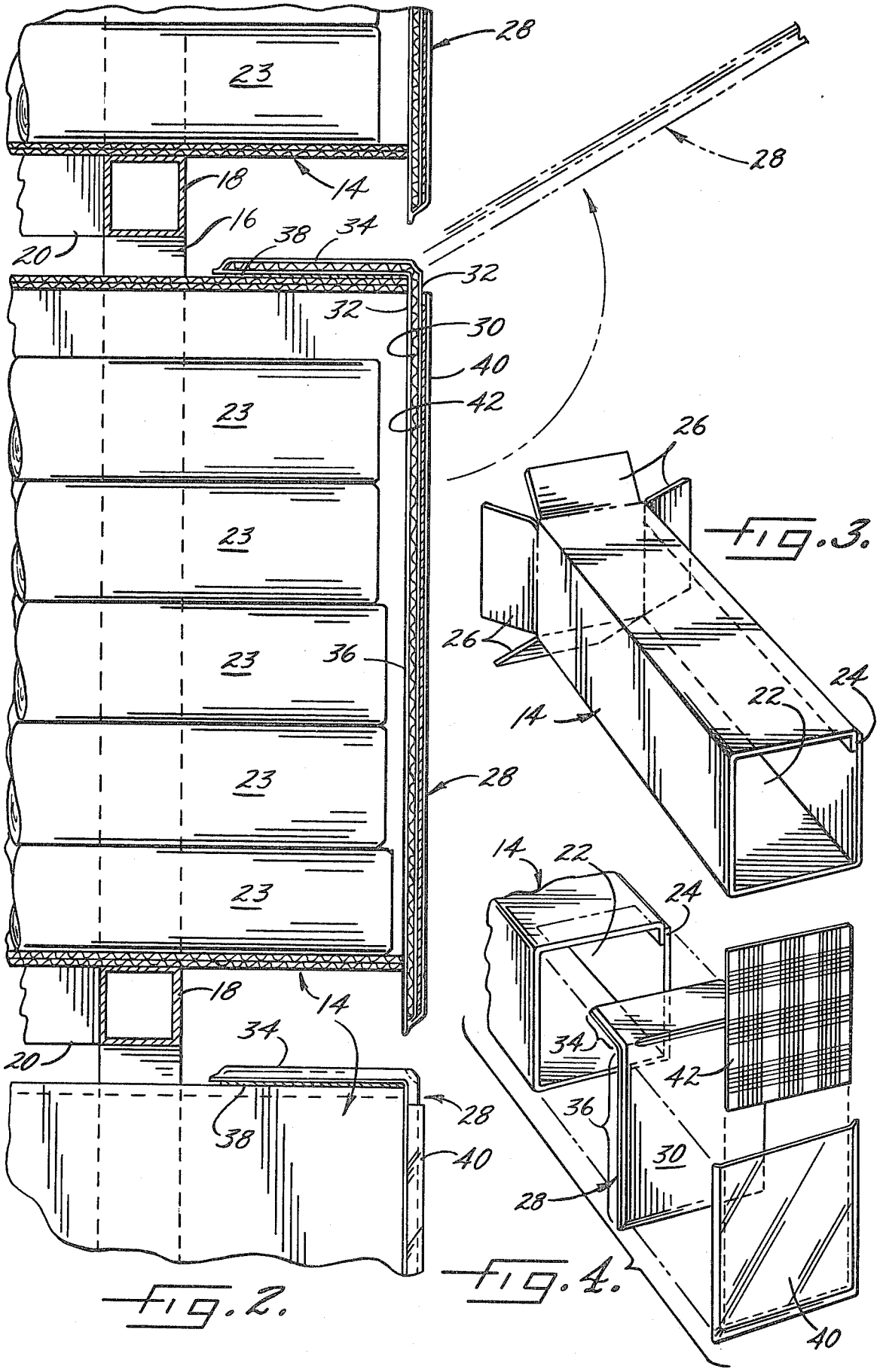
FIG. 2 is a fragmentary side view of the storage rack of FIG. 1.
FIG. 3 is a perspective view of a storage bin for the storage and display rack.
FIG. 4 is an exploded perspective view of an opening and flap of a bin of the invention.

In the preferred embodiment, and as best shown in FIG. 3, each bin 14 is a hollow parallelepiped having a substantially rectangular cross-section with an opening 22 at its front end. The bin 14 is advantageously made from double-walled corrugated construction cardboard having a test strength of at least about 500 pounds. The bins 14 of this invention can be made of inexpensive cardboard due to the way in which the bins and the support frame interact. Because the bins 14 are wedged securely into the frame, the walls of adjacent bins 14 and the uprights 16 coact to support the heavy rolls 23 of wallpaper (FIGS. 1 and 2) contained in each bin 14. Without this snug fit, the vertical sides of cardboard bins would bow out or buckle because of the pressure exerted upon them by the rolls 23 of wallpaper.

Referring to FIGS. 3 and 4, each bin 14 is formed with a lap seam 24 and, at the (closed) end of the bin opposite the opening 22, the bin 14 is closed by a conventional arrangement of flaps 26. The bins can be shipped unfolded and assembled with glue or staples or the like. Each bin is sized from front to back so that a roll of wallpaper, which is usually 28" in length, can fit within the bin without protruding through the front opening 22.

A flap 28 which is sized to cover the opening 22 is attached to the top near the front of each bin. This flap 28 allows access to the contents of each bin 14 while preventing the entrance of dirt and dust into the bin which would damage the wallcovering stored within. Because the bin opening is covered, excessive, unnecessary handling of the rolls of wallpaper by customers and pilferage are discouraged. Additionally, the flap 28 prevents customers from seeing unsightly roll ends or, if a certain pattern of wallpaper is out of stock, an empty bin, both of which would detract from the appearance of the display and its effectiveness in marketing its contents.

As best seen in FIG. 2, in the preferred embodiment the flap 28 is made from corrugated cardboard 30 covered by a covering sheet 32 of vinyl or other plastic. The cardboard 30 in the flap 28 allows it to lay flat over the opening of the bin, and the covering 32 provides for a more resilient, longer lived, hinge, and generally provides for a more attractive appearance for the display. The flap 28 comprises a mounting portion 34 and a cover portion 36. The mounting portion is attached to the top side of the upper wall of the bin 14 with an adhesive 38. To gain access to the contents of the bin, the cover is merely lifted up. This may be facilitated by extending the cover below the bottom of the bin so as to provide an area which can be easily gripped.

Additionally, the front of the cover 36 is provided with a clear vinyl or plastic pocket 40, which permits a sample 42 of the wallpaper that is to be stored within the bin 14 to be displayed therein. The pocket is sized so that a sample which is substantially the same size as the cover portion of the flap may be displayed. Additionally, the pocket is open along its upper edge so as to permit samples to be removed from the flap if the pattern of the covering contained within the bin is changed. When all the bins are located on the support frame, the flaps present samples of all the patterns of wall covering contained within those bins, the samples all being in the same visual plane, permitting side-by-side comparison of the patterns and thus facilitating the selection of the desired pattern.

It is apparent that there has been provided, in accordance with the invention, a combined storage and display assembly for rolls of wallpaper that fully satisfies the objects set forth above. While the invention has been described in conjunction with specific embodiments thereof, it is evident that many alternatives, modifications, and variations will be apparent to those skilled in the art in light of the foregoing description. Accordingly, the invention is not to be limited to the specific embodiment illustrated but is to cover all alternatives, modifications and variations which come within the spirit and scope of the appended claims.

We claim as our invention:

1. A storage and display system for holding rolls of decorative wall coverings and the like comprising, in combination:

(a) a support frame having vertical members at its corners, and horizontal members at its front, rear and sides to define a plurality of shelves;

(b) a row of bins on each shelf, each bin comprising a horizontally elongated parallelepiped made from corrugated cardboard and having a substantially rectangular cross-section and opening at its front end, each bin being placed across the shelves so that the vertical walls of adjacent bins and the vertical members of the support frame are in close, side-by-side relationship so as to support the contents of each bin; and (c) a flap sized to cover the opening at the front of the bind and hingedly attached to the outside of the top near the front of each bin so that gravity causes the flaps to overlie the opening of its bin, said flap having a clear pocket on its outer surface open along its upper edge so that a sample of the wall covering stored within each bin can be displayed therefrom.

2. The combination of claim 1 wherein the flap is sized to extend downward of the opening of the bin so as to provide gripping means for manually lifting the flap.

3. The combination of claim 1 or 2 wherein the flap comprises cardboard covered with plastic.

* * * * *